US009779590B2

(12) United States Patent
Ye

(10) Patent No.: US 9,779,590 B2
(45) Date of Patent: Oct. 3, 2017

(54) MULTICOLOR SIGNAL LIGHT AND CONTROLLING METHOD THEREOF

(71) Applicant: SCHNEIDER ELECTRIC INDUSTRIES SAS, Rueil-Malmaison (FR)

(72) Inventor: Jun Ye, Shanghai (CN)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/474,769

(22) Filed: Sep. 2, 2014

(65) Prior Publication Data

US 2016/0063823 A1 Mar. 3, 2016

(51) Int. Cl.

| | |
|---|---|
| ***G08B 5/36*** | (2006.01) |
| ***H05B 33/08*** | (2006.01) |
| *G08B 5/38* | (2006.01) |

(52) U.S. Cl.

CPC ..... *G08B 5/36* (2013.01); *H05B 33/0857* (2013.01); *G08B 5/38* (2013.01)

(58) Field of Classification Search

CPC ... G09F 9/33; G09F 9/30; G09F 9/302; G09F 9/3023; G09F 9/00; H05B 33/08; H05B 33/0842; B60Q 1/2696

See application file for complete search history.

(56) References Cited

U.S. PATENT DOCUMENTS

| | | | | |
|---|---|---|---|---|
| 8,378,781 | B1 * | 2/2013 | Peterson | H05B 33/0842 340/3.5 |
| 2007/0262726 | A1 | 11/2007 | Peng | |
| 2008/0088571 | A1 | 4/2008 | Lee et al. | |
| 2008/0204431 | A1 * | 8/2008 | Chung | G09G 3/2014 345/204 |
| 2008/0224849 | A1 * | 9/2008 | Sirhan | F21V 23/0442 340/521 |
| 2015/0189715 | A1 * | 7/2015 | Reidt | H05B 33/0818 315/307 |

(Continued)

FOREIGN PATENT DOCUMENTS

| | | | |
|---|---|---|---|
| CN | 201042097 | Y | 3/2008 |
| CN | 101581422 | A | 11/2009 |

(Continued)

OTHER PUBLICATIONS

Extended European Search Report for corresponding EP1418179 mailed Feb. 4, 2015.

(Continued)

*Primary Examiner* — Hongmin Fan
(74) *Attorney, Agent, or Firm* — Lando & Anastasi, LLP

(57) ABSTRACT

The present invention provides a multicolor signal light and a controlling method thereof. The multicolor signal light includes: a multicolor layer, comprising a plurality of lights being capable of lighting multicolor lights and arranged in a certain pattern; a single control signal line for receiving a control signal from a controller outside; a processor for controlling the multicolor layer to light in a different mode and in a different color according to the control signal received by the single control signal line; and power supply terminals for receiving power supply voltage from outside.

6 Claims, 5 Drawing Sheets

(56) References Cited

U.S. PATENT DOCUMENTS

2015/0279168 A1* 10/2015 Avrahami ..... G08B 25/016
340/539.11

FOREIGN PATENT DOCUMENTS

| | | | |
|---|---|---|---|
| CN | 101725861 | A | 6/2010 |
| CN | 201680171 | U | 12/2010 |
| DE | 10038559 | A1 | 10/2001 |
| EP | 2603055 | A1 | 6/2013 |
| EP | 2629589 | A2 | 8/2013 |
| WO | 2010015202 | A1 | 2/2010 |

OTHER PUBLICATIONS

First Office Action for corresponding Chinese Patent Application No. 201310122691.8 mailed Sep. 24, 2015.
Second Office Action for corresponding Chinese Patent Application No. 201310122691.8 mailed Mar. 9, 2016.
Third Chinese Office Action from corresponding Chinese Patent Application No. 201310122691.8 issued Aug. 22, 2016 [English translation attached].
Fourth Chinese Office Action from corresponding Chinese Patent Application No. 201310122691.8 dated Mar. 13, 2017 [English translation attached].

* cited by examiner

MULTICOLOR SIGNAL LIGHT AND CONTROLLING METHOD THEREOF

TECHNICAL FIELD

The present disclosure relates to a multicolor signal light and a controlling method thereof, and more particularly, to a multicolor signal light controlled by a single control signal line and a controlling method thereof.

BACKGROUND

A multicolor signal light is generally used as a signal indicator in an OEM machine to send a message to an operator. The multicolor signal light is composed of several layers with different colors. Normally the multicolor signal light is controlled by a programmable controller (PLC) in the OEM machine. One layer of the multicolor signal light is controlled by one output control signal of the PLC. As illustrated in FIG. 1, the multicolor signal light 1 controlled by the PLC 2 in the prior art comprises three color layers of red R, yellow Y and green G, for example, and each of the color layers of the multicolor signal light 1 is composed of a plurality of LEDs emitting light with a fixed color. Three control signals PLC_R, PLC_Y, PLC_G and a common ground signal COM are connected between the multicolor signal light 1 and the PLC 2. A control circuit, for example, a processor and the like, included inside the multicolor signal light 1 receives the control signals PLC_R, PLC_Y, PLC_G and controls an emitting of the multicolor signal light 1 according to the control signals PLC_R, PLC_Y, PLC_G. Such structure of the multicolor signal light shown in FIG. 1 is relatively complex, such that a manufacture cost is increased and a process as arranging wires actually is annoying.

In FIG. 1, in order to transfer information, the PLC 2 requires the three control signals PLC_R, PLC_Y, PLC_G so as to control the three color layers of the multicolor signal light 1 to emit light respectively to deliver messages, and each of the color layers is needed to be connected to the corresponding output control signal of the PLC, which results in a high control cost of the multicolor signal light 1.

In a typical application for the multicolor signal light, only one color layer operates during a given period of time in most cases, while remaining color layers would not operate but are wasted.

Therefore, there is needed a multicolor signal light and a control method thereof which has a simple structure, a low cost in control and manufacture, and a simple manufacture process, in order to indicate various message to the operators conveniently.

SUMMARY

At least one aspect provides a multicolor signal light and a control method thereof which has a simple structure, a low cost in control and manufacture, and a simple manufacture process, in order to indicate various messages to the operators conveniently.

According to an aspect of the present disclosure, there is provided a multicolor signal light, comprising: a multicolor layer comprising a plurality of lights being capable of emitting multicolor lights and arranged in a certain pattern; a single control signal line for receiving a control signal from a controller outside; a processor for controlling the multicolor layer to emit light in different modes and in different colors according to the control signal received by the single control signal line; and power supply terminals for receiving external power supply voltages from outside.

In an example, the control signal provided from the controller outside is a control pulse.

In an example, the external power supply voltage is 24 VDC or 12 VDC.

In an example, the light capable of emitting multicolor lights is a LED light.

In an example, a light-emitting mode comprises one of flickering and rotating or a combination of the two.

In an example, the light-emitting mode comprises the flickering and rotating at different frequencies.

According to another aspect of the present disclosure, there is provided a method for controlling the multicolor signal light described above, wherein a light-emitting color and/or the light-emitting mode of the multicolor signal light are controlled according to a variable and metrizable feature of a control pulse received.

In an example, the light-emitting color or the light-emitting mode of the multicolor signal light are controlled according to the metrizable feature indicating one of a duty ratio, a frequency and an amplitude of the control pulse received.

In an example, the light-emitting color or the light-emitting mode of the multicolor signal light are controlled according to the metrizable feature indicating a combination of the duty ratio, the frequency and/or the amplitude of the control pulse received.

In an example, the light-emitting mode comprises one of flickering and rotating or a combination of the two.

In an example, the light-emitting mode comprises the flickering and rotating at different frequencies.

BRIEF DESCRIPTION OF THE DRAWINGS

The present disclosure will become more fully understood from the detailed description given for example embodiments in connection with the accompanying drawings. It should be understood that the example embodiments are given by way of illustration and exemplarity only, and thus are not limitative of the present disclosure. The spirit and scope of the present disclosure are defined by details in Claims. A brief description of drawings is given below, wherein:

DETAILED DESCRIPTION

A multicolor signal light controlled by a PLC and a control method thereof according to the present disclosure will now described in details by referring to FIGS. 2-6.

Figure 1:
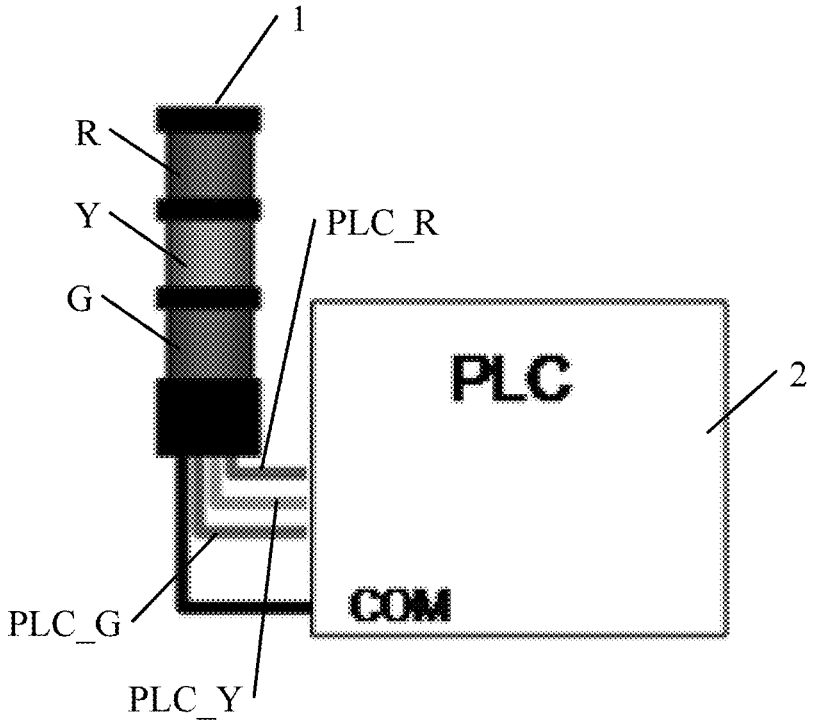
FIG. 1 is an exemplary view illustrating an external structure of a multicolor signal light controlled by a PLC in the prior art.
Figure 2:
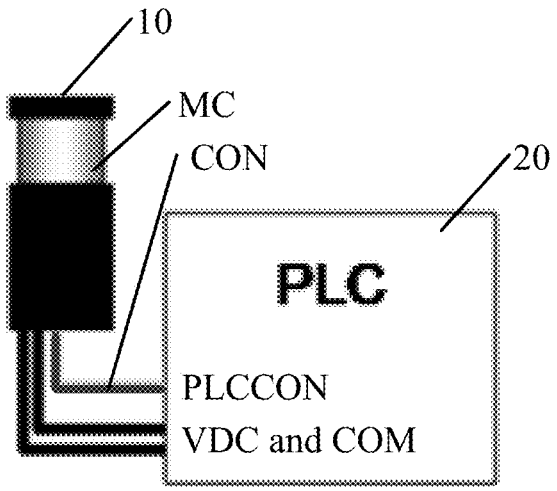
FIG. 2 is an exemplary view illustrating an external structure of a multicolor signal light controlled by a PLC according to the present disclosure.
Figure 3:
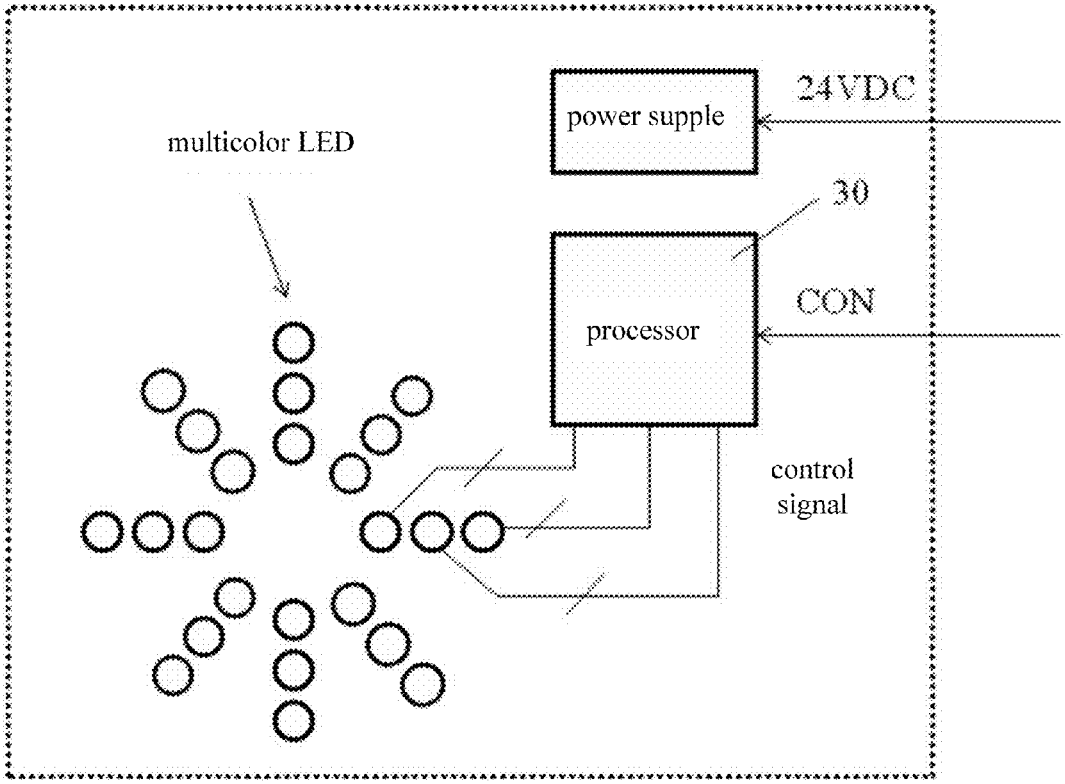
FIG. 3 is an exemplary view illustrating an internal structure of the multicolor signal light controlled by the PLC according to the present disclosure.

FIG. 2 is an exemplary view illustrating an external structure of a multicolor signal light 10 controlled by a PLC according to the present disclosure. FIG. 3 is an exemplary view illustrating an internal structure of the multicolor signal light controlled by the PLC according to the present disclosure.

It can be seen by referring to FIGS. 2-3 together, the multicolor signal light 10 according to the present disclosure is a multicolor signal light controlled by a single control line.

The multicolor signal light 10 controlled by the PLC according to the present disclosure, as illustrated in FIG. 2, comprises: one multicolor layer MC capable of emitting multicolor lights; one control signal terminal CON connected to an external device such as the PLC 20 and configured to receive a control signal PLC_CON in order to control the multicolor layer MC to emit light according to the control signal PLC_CON; and a direct-current power supply signal VDC terminal and a common ground signal COM terminal for receiving powers supplied from outside. For example, the direct-current power supply signal VDC is a 24V DC signal or a 12V DC signal, etc. The direct-current power supply signal VDC terminal and the common ground signal COM terminal may be directly connected to corresponding terminals on the PLC 20 so as to obtain the power supplies from the PLC 20.

Referring to FIG. 3, the unique multicolor layer MC of the multicolor signal light 10 comprises a plurality of LED lights, which are capable of emitting multicolor lights, for example, red, yellow, orange, green, blue, white, etc, and arranged in a certain pattern. In FIG. 3, every three LEDs form a light bar and a plurality of the light bars are arranged in a form of ring. However, the present disclosure is not limited to the light-emitting colors, the number and the arranged pattern of the LED lights shown in FIG. 3.

Referring to FIG. 3, the multicolor signal light 10 according to the present disclosure further comprises a processor 30. The processor 30 receives the control signal PLC_CON via the control signal terminal CON and processes the control signal PLC_CON to acquire control signals for each LED light, and then the LED light emits light according to the control signal for each LED light generated by the processor 30.

In FIG. 2, a number of lines between the multicolor signal light 10 and the PLC 20 are reduced to 3 from above 4 in the prior art, and the multicolor signal light 10 comprises only one multicolor layer MC, therefore the structure of the multicolor signal light 10 becomes simpler, which reduces a production cost of the multicolor signal light greatly.

In FIG. 2, the PLC 20 is only required to use one control signal PLC_CON to control the unique multicolor layer MC of the multicolor signal light 10 so as to transfer messages, which reduces both of a control cost and a manpower cost for programming and wiring of the PLC 20 of the multicolor signal light 10.

In an aspect of the present disclosure, the control signal PLC_CON output from the PLC 20 may be a Pulse Width Modulation (PWM) pulse signal whose duty ratio is variable, and for a sake of convenience, such control signal would be called as a PLC_PWM control signal thereafter.

A user can make the PLC 20 to generate the PLC_PWM control signal whose duty ratio is variable by programming the PLC 20.

According to a value of the duty ratio of the PLC_PWM control signal, a control protocol may be defined between the PLC 20 and the processor 30 of the multicolor signal light 10 to control which color of light the multicolor signal light 10 emits. An example of the control protocol is as follows.

A pulse cycle of the PLC_PWM control signal is 100 ms, and its frequency is 10 Hz. The multicolor signal light 10 emits the red light when the duty ratio of the PLC_PWM control signal is 100%; the multicolor signal light 10 emits the yellow light when the duty ratio of the PLC_PWM control signal is 80%; the multicolor signal light 10 emits the orange light when the duty ratio of the PLC_PWM control signal is 70%; the multicolor signal light 10 emits the green light when the duty ratio of the PLC_PWM control signal is 60%; the multicolor signal light 10 emits the blue light when the duty ratio of the PLC_PWM control signal is 50%; and the multicolor signal light 10 emits the white light when the duty ratio of the PLC_PWM control signal is 40%.

Further, according to the value of the duty ratio of the PLC_PWM control signal, another control protocol may be defined between the PLC 20 and the processor 30 of the multicolor signal light 10 to control which color of light and in which light-emitting mode the multicolor signal light 10 emits. An example of the control protocol is as follows.

The multicolor signal light 10 emits the red light in the light-emitting mode of flickering when the duty ratio of the PLC_PWM control signal is 30%; the multicolor signal light 10 emits the yellow light in the light-emitting mode of flickering when the duty ratio of the PLC_PWM control signal is 20%; and the multicolor signal light 10 emits the orange light in the light-emitting of flickering when the duty ratio of the PLC_PWM control signal is 10%.

Other than the light-emitting of flickering, other light-emitting modes common used can also be selected, for example, a light-emitting mode in which the LED lights in the multicolor layer MC are caused to emit light with a specified color rotationally in turn clockwise or counter-clockwise; or they are caused to emit light in a light-emitting mode of combination of the flicking and rotating. The control protocols described above between the PLC 20 and the process 30 of the multicolor signal light 10 are only examples by way of illustration, and the present disclosure is not limited thereto. Those ordinary skilled in the art may control the emitting of the multicolor signal light 10 diversely based on the variable value of the duty ratio depending on actual technique requirements, in order to transfer information flexibly and conveniently. For example, different schemes may be further designed in terms of a flickering frequency as emitting.

The processor 30 of the multicolor signal light 10 receives the PLC_PWM control signal transmitted from the PLC 20 and calculates the duty ratio of the PLC_PWM control signal, such that a light with the corresponding color is emitted in the corresponding mode according to the above control protocol based on the calculated duty ratio, in order to transfer the respective message.

Furthermore, according to another aspect of the present disclosure, the control signal PLC_CON output from the PLC 20 may be a Pulse Frequency Modulation (PFM) pulse signal whose frequency is variable, and for a sake of convenience, such control signal would be called as a PLC_PFM control signal thereafter.

The user can make the PLC 20 to generate the PLC_PFM control signal whose frequency is variable by programming the PLC 20.

According to a value of the frequency of the PLC_PFM control signal, a control protocol may be defined between the PLC 20 and the processor 30 of the multicolor signal light 10 to control which color of light the multicolor signal light 10 emits. An example of the control protocol is as follows.

The multicolor signal light 10 emits the red light when the frequency of the PLC_PFM control signal is 10 Hz; the multicolor signal light 10 emits the yellow light when the frequency of the PLC_PFM control signal is 20 Hz; the multicolor signal light 10 emits the orange light when the frequency of the PLC_PFM control signal is 30 Hz; the multicolor signal light 10 emits the green light when the frequency of the PLC_PFM control signal is 40 Hz; the multicolor signal light 10 emits the blue light when the frequency of the PLC_PFM control signal is 50 Hz; and the multicolor signal light 10 emits the white light when the frequency of the PLC_PFM control signal is 60 Hz.

Further, according to the value of the frequency of the PLC_PFM control signal, another control protocol may be defined between the PLC 20 and the processor 30 of the multicolor signal light 10 to control which color of light and in which light-emitting mode the multicolor signal light 10 emits. An example of the control protocol is as follows.

The multicolor signal light 10 emits the red light in the light-emitting mode of flickering when the frequency of the PLC_PFM control signal is 70 Hz; the multicolor signal light 10 emits the yellow light in the light-emitting mode of flickering when the frequency of the PLC_PFM control signal is 80 Hz; and the multicolor signal light 10 emits the orange light in the light-emitting of flickering when the frequency of the PLC_PFM control signal is 90 Hz.

The control protocols described above between the PLC 20 and the process 30 of the multicolor signal light 10 are only examples by way of illustration, and the present disclosure is not limited thereto. Those ordinary skilled in the art may control the emitting of the multicolor signal light 10 diversely based on the variable value of the frequency depending on actual technique requirements, in order to transfer information flexibly and conveniently. For example, different schemes may be further designed in terms of a flickering frequency as emitting.

The processor 30 of the multicolor signal light 10 receives the PLC_PFM control signal transmitted from the PLC 20 and calculates the frequency of the PLC_PFM control signal, such that a light with the corresponding color is emitted in the corresponding mode according to the above control protocol based on the calculated duty ratio, in order to transfer the respective message.

Furthermore, according to a still another aspect of the present disclosure, the control signal PLC_CON output from the PLC 20 may be a Pulse Width Modulation-Pulse Frequency Modulation (PWM-PFM) pulse signal whose duty ratio and frequency are both variable, and for a sake of convenience, such control signal will be referred to as a PLC_PWM-PFM control signal hereafter.

The user can make the PLC 20 generate the PLC_PFM-PFM control signal whose duty ratio and frequency are both variable by programming the PLC 20.

According to the values of the duty ratio and the frequency of the PLC_PWM-PFM control signal, a control protocol may be defined between the PLC 20 and the processor 30 of the multicolor signal light 10 to control which color of light the multicolor signal light 10 emits. An example of the control protocol is as follows.

The multicolor signal light 10 emits the red light when the frequency of the PLC_PFM control signal is 10 Hz and its duty ratio is 100%; the multicolor signal light 10 emits the yellow light when the frequency of the PLC_PWM-PFM control signal is 10 Hz and its duty ratio is 90%; the multicolor signal light 10 emits the orange light when the frequency of the PLC_PWM-PFM control signal is 30 Hz and its duty ratio is 80%; the multicolor signal light 10 emits the green light when the frequency of the PLC_PWM-PFM control signal is 30 Hz and its duty ratio is 70%; the multicolor signal light 10 emits the blue light when the frequency of the PLC_PWM-PFM control signal is 50 Hz and its duty ratio is 60%; and the multicolor signal light 10 emits the white light when the frequency of the PLC_PWM-PFM control signal is 50 Hz and its duty ratio is 50%.

Further, according to the values of the duty ratio and the frequency of the PLC_PWM-PFM control signal, another control protocol may be defined between the PLC 20 and the processor 30 of the multicolor signal light 10 to control which color of light and in which light-emitting mode the multicolor signal light 10 emits. An example of the control protocol is as follows.

The multicolor signal light 10 emits the red light in the light-emitting mode of flickering when the frequency of the PLC_PWM-PFM control signal is 70 Hz and its duty ratio is 100%; the multicolor signal light 10 emits the yellow light in the light-emitting mode of flickering when the frequency of the PLC_PWM-PFM control signal is 80 Hz and its duty ratio is 90%; and the multicolor signal light 10 emits the orange light in the light-emitting of flickering when the frequency of the PLC_PWM-PFM control signal is 90 Hz and its duty ratio is 80%.

The control protocols described above between the PLC 20 and the process 30 of the multicolor signal light 10 are only examples by way of illustration, and the present disclosure is not limited thereto. Those ordinary skilled in the art may control the emitting of the multicolor signal light 10 diversely based on various combinations of the variable value of the frequency and the variable value of the duty ratio depending on actual technique requirements, in order to transfer information flexibly and conveniently. For example, different schemes may be further designed in terms of a flickering frequency as emitting.

The processor 30 of the multicolor signal light 10 receives the PLC_PWM-PFM control signal transmitted from the PLC 20 and calculates the duty ratio and the frequency of the PLC_PWM-PFM control signal, such that a light with the corresponding color is emitted in the corresponding mode according to the above control protocol based on the calculated duty ratio, frequency in order to transfer the respective message.

Above is described how to control the light-emitting color and the light-emitting mode of the multicolor signal light 10 according to the duty ratio, the frequency of the control pulse generated by the PLC 20 and the combination thereof. The light-emitting color and the light-emitting mode of the multicolor signal light 10 may be further controlled according to an amplitude of the control pulse generated by the PLC 20. alternatively, the light-emitting color and the light-emitting mode of the multicolor signal light 10 may be further controlled according to a combinative feature of the duty ratio, the frequency and the amplitude of the control pulse generated by the PLC 20, in order to transfer rich information to the operator.

Herein, a PLC is an example of a controller for generating the control pulse required to control the multicolor signal light according to the present disclosure to emit light, but the present disclosure is not limited thereto, and those skilled in the art can use any other controller to generate the control pulse required herein.

In brief, those skilled in the art can control the light-emitting color and the light-emitting mode of the multicolor signal light 10 according to the metrizable feature(s), which is variable, of the control signal generated by the PLC 20.

More widely, those skilled in the art can further control an information transferring of other devices for transferring the information such as a buzzer according to the metrizable feature(s), which is variable, of the control signal generated by the PLC 20.

Figure 4:
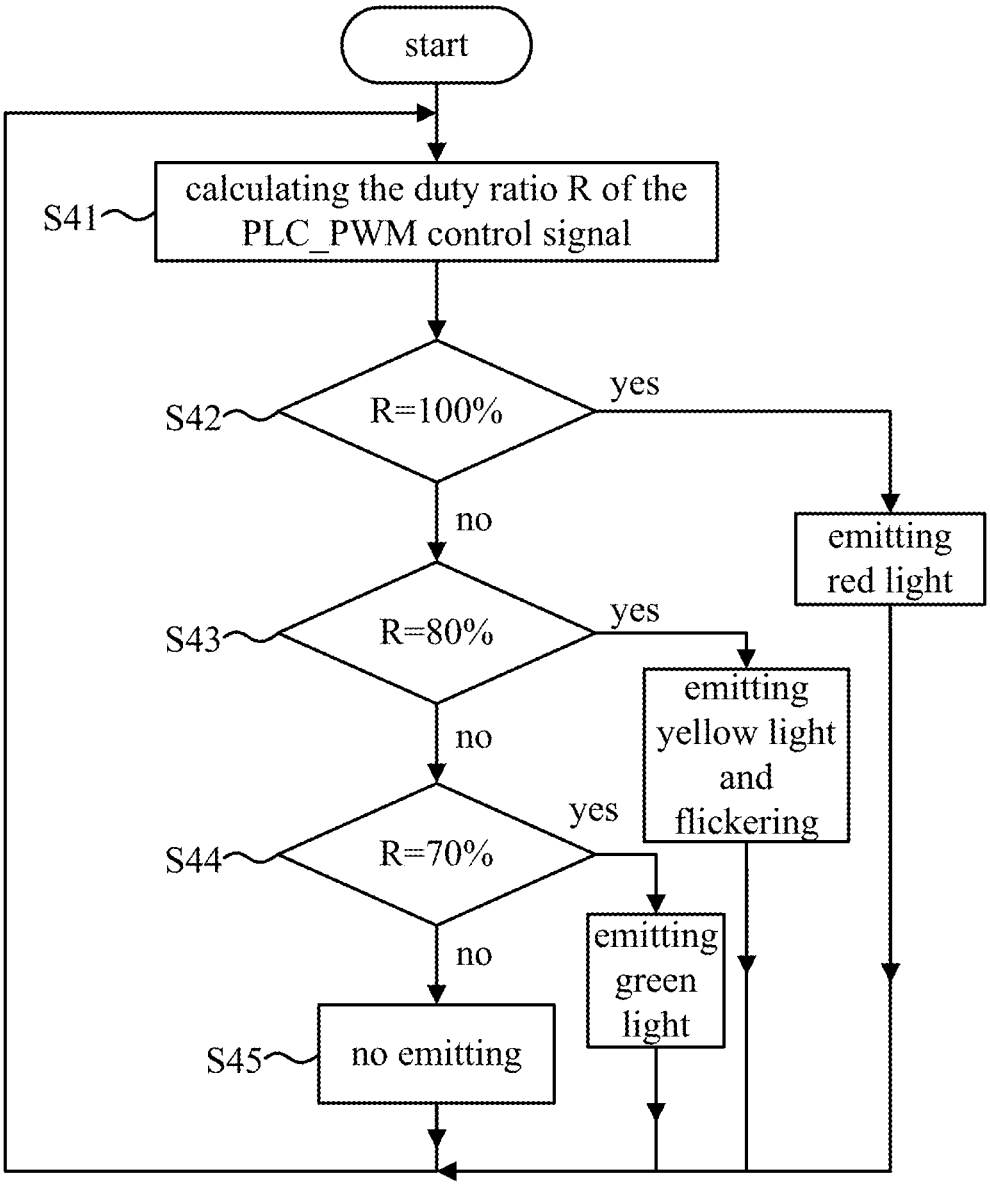
FIG. 4 is a flowchart illustrating a first embodiment of a control method for the multicolor signal light controlled by the PLC according to the present disclosure.

FIG. 4 is a flowchart illustrating a first embodiment of a control method for the multicolor signal light controlled by the PLC according to the present disclosure.

The first embodiment of the control method for the multicolor signal light controlled by the PLC according to the present disclosure illustrated in FIG. 4 will be described in connection with the multicolor signal light 10 shown in FIGS. 2-3.

At first, the control signal PLC_CON output from the PLC 20 is a Pulse Width Modulation (PWM) pulse signal whose duty ratio is variable, and for a sake of convenience, such control signal is referred to as a PLC_PWM control signal. The processor 30 of the multicolor signal light 10 receives the PLC_PWM control signal output from the PLC 20.

In FIG. 4, assuming that the control protocol between the PLC 20 and the processor 30 of the multicolor signal light 10 is as follows: the multicolor signal light 10 emits the red light when the duty ratio of the PLC_PWM control signal is 100%; the multicolor signal light 10 emits the yellow light in the light-emitting mode of flickering when the duty ratio of the PLC_PWM control signal is 80%; and the multicolor signal light 10 emits the green light when the duty ratio of the PLC_PWM control signal is 70%.

At a step S41, the processor 30 of the multicolor signal light 10 calculates the duty ratio R of the PLC_PWM control signal.

At a step S42, the processor 30 of the multicolor signal light 10 compares the calculated duty ratio R of the PLC_PWM control signal with a first threshold, for example, 100%.

If the calculated duty ratio R of the PLC_PWM control signal is equal to 100% at the step S42, the multicolor signal light 10 emits the red light, and the process returns to the step S41 and starts a next cycle.

If the calculated duty ratio R of the PLC_PWM control signal is not equal to 100% at the step S42, then the processor 30 of the multicolor signal light 10 compares the calculated duty ratio R of the PLC_PWM control signal with a second threshold, for example, 80%, at a step S43.

If the calculated duty ratio R of the PLC_PWM control signal is equal to 80% at the step S43, the multicolor signal light 10 emits the yellow light in the light-emitting mode of flickering, and the process returns to the step S41 and starts a next cycle.

If the calculated duty ratio R of the PLC_PWM control signal is not equal to 80% at the step S43, then the processor 30 of the multicolor signal light 10 compares the calculated duty ratio R of the PLC_PWM control signal with a third threshold, for example, 70%, at a step S44.

If the calculated duty ratio R of the PLC_PWM control signal is equal to 70% at the step S44, the multicolor signal light 10 emits the green light, and the process returns to the step S41 and starts a next cycle.

If the calculated duty ratio R of the PLC_PWM control signal is not equal to 70% at the step S44, then the multicolor signal light 10 does not emit light at a step S45, then the process returns to the step S41 and starts a next cycle.

In the embodiment shown in FIG. 4, the first, the second and the third thresholds are not identical to each other.

Figure 5:
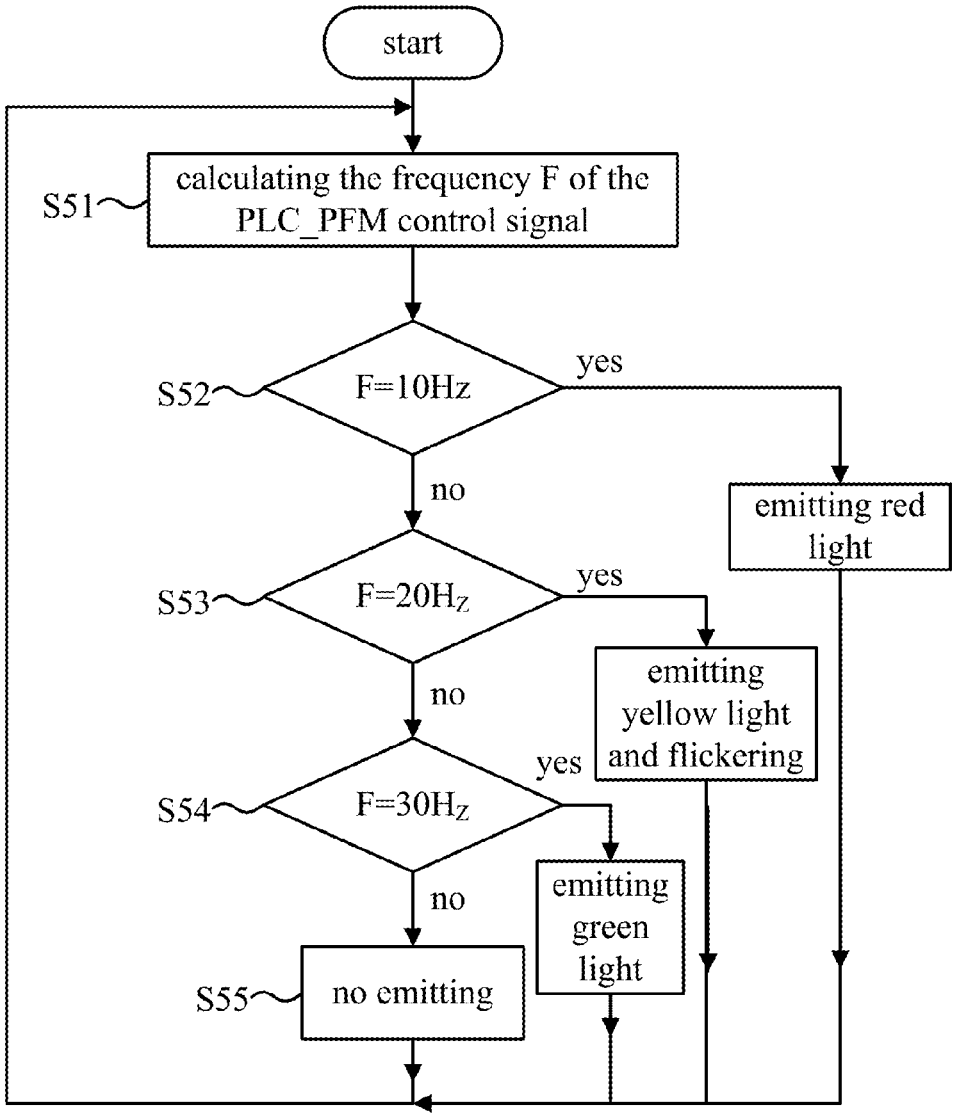
FIG. 5 is a flowchart illustrating a second embodiment of a control method for the multicolor signal light controlled by the PLC according to the present disclosure.

FIG. 5 is a flowchart illustrating a second embodiment of a control method for the multicolor signal light controlled by the PLC according to the present disclosure.

The second embodiment of the control method for the multicolor signal light controlled by the PLC according to the present disclosure illustrated in FIG. 5 will be described in connection with the multicolor signal light 10 according to the present disclosure shown in FIGS. 2-3.

At first, the control signal PLC_CON output from the PLC 20 is a Pulse Frequency Modulation (PFM) pulse signal whose frequency is variable, and for a sake of convenience, such control signal will be referred to as a PLC_PFM control signal. The processor 30 of the multicolor signal light 10 receives the PLC_PFM control signal output from the PLC 20.

In FIG. 5, assuming that the control protocol between the PLC 20 and the processor 30 of the multicolor signal light 10 is as follows: the multicolor signal light 10 emits the red light when the frequency of the PLC_PFM control signal is 10 Hz; the multicolor signal light 10 emits the yellow light in the light-emitting mode of flickering when the frequency of the PLC_PFM control signal is 20 Hz; and the multicolor signal light 10 emits the green light when the frequency of the PLC_PFM control signal is 30 Hz.

At a step S51, the processor 30 of the multicolor signal light 10 calculates the frequency F of the PLC_PFM control signal.

At a step S52, the processor 30 of the multicolor signal light 10 compares the calculated frequency F of the PLC_PFM control signal with a first threshold, for example, 10 Hz.

If the calculated frequency F of the PLC_PFM control signal is equal to 10 Hz at the step S52, the multicolor signal light 10 emits the red light, and the process returns to the step S51 and starts a next cycle.

If the calculated frequency F of the PLC_PFM control signal is not equal to 10 Hz at the step S52, then the processor 30 of the multicolor signal light 10 compares the calculated frequency F of the PLC_PFM control signal with a second threshold, for example, 20 Hz, at a step S53.

If the calculated frequency F of the PLC_PFM control signal is equal to 20 Hz at the step S53, the multicolor signal light 10 emits the yellow light in the light-emitting mode of flickering, and the process returns to the step S51 and starts a next cycle.

If the calculated frequency F of the PLC_PFM control signal is not equal to 20 Hz at the step S53, then the processor 30 of the multicolor signal light 10 compares the calculated frequency F of the PLC_PFM control signal with a third threshold, for example, 30 Hz, at a step S54.

If the calculated frequency F of the PLC_PFM control signal is equal to 30 Hz at the step S54, the multicolor signal light 10 emits the green light, and the process returns to the step S51 and starts a next cycle.

If the calculated frequency F of the PLC_PFM control signal is not equal to 30 Hz at the step S54, then the multicolor signal light 10 does not emit light at a step S55, then the process returns to the step S51 and starts a next cycle.

In the embodiment shown in FIG. 5, the first, the second and the third thresholds are not identical to each other.

Figure 6:
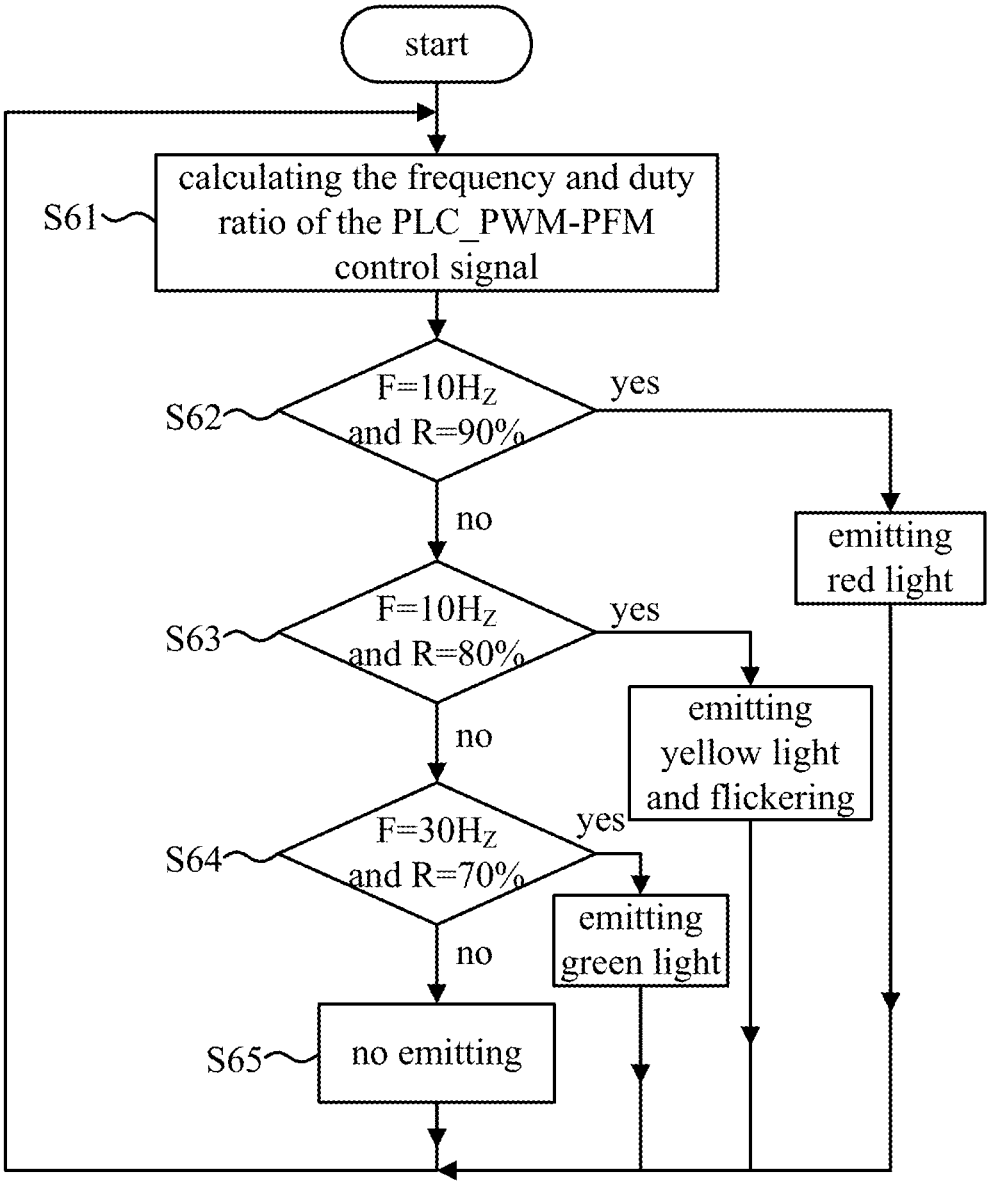
FIG. 6 is a flowchart illustrating a third embodiment of a control method for the multicolor signal light controlled by the PLC according to the present disclosure.

FIG. 6 is a flowchart illustrating a third embodiment of a control method for the multicolor signal light controlled by the PLC according to the present disclosure The Third embodiment of the control method for the multicolor signal light controlled by the PLC according to the present disclosure illustrated in FIG. 6 will be described in connection with the multicolor signal light 10 according to the present disclosure shown in FIGS. 2-3.

At first, the control signal PLC_CON output from the PLC 20 is a Pulse Width Modulation-Pulse Frequency Modulation (PWM-PFM) pulse signal whose duty ratio and frequency are both variable, and for a sake of convenience, such control signal will be referred to as a PLC_PWM-PFM control signal. The processor 30 of the multicolor signal light 10 receives the PLC_PWM-PFM control signal output from the PLC 20.

In FIG. 6, assuming that the control protocol between the PLC 20 and the processor 30 of the multicolor signal light 10 is as follows: the multicolor signal light 10 emits the red light when the frequency of the PLC_PFM control signal is 10 Hz and its duty ratio is 90%; the multicolor signal light 10 emits the yellow light in the light-emitting mode of flickering when the frequency of the PLC_PFM control signal is 10 Hz and its duty ratio is 80%; and the multicolor signal light 10 emits the green light when the frequency of the PLC_PFM control signal is 30 Hz and its duty ratio is 70%.

At a step S61, the processor 30 of the multicolor signal light 10 calculates the frequency F and the duty ratio R of the PLC_PWM-PFM control signal.

At a step S62, the processor 30 of the multicolor signal light 10 compares the calculated frequency F of the PLC_PWM-PFM control signal with a first frequency threshold, for example, 10 Hz, and compares the calculated duty ratio R of the PLC_PWM-PFM control signal with a first duty ratio threshold, for example, 90%.

If the calculated frequency F of the PLC_PWM-PFM control signal is equal to 10 Hz and the calculated duty ratio R of the PLC_PWM-PFM control signal is equal to 90% at the step S62, the multicolor signal light 10 emits the red light, and the process returns to the step S61 and starts a next cycle.

If the calculated frequency F of the PLC_PWM-PFM control signal is not equal to 10 Hz or the calculated duty ratio R of the PLC_PWM-PFM control signal is not equal to 90% at the step S62, then the processor 30 of the multicolor signal light 10 compares the calculated frequency F of the PLC_PWM-PFM control signal with a second frequency threshold, for example, 10 Hz, and compares the calculated duty ratio R of the PLC_PWM-PFM control signal with a second duty ratio threshold, for example, 80%, at a step S63.

If the calculated frequency F of the PLC_PWM-PFM control signal is equal to 10 Hz and the calculated duty ratio R of the PLC_PWM-PFM control signal is equal to 80% at the step S63, the multicolor signal light 10 emits the yellow light in the light-emitting mode of flickering, and the process returns to the step S61 and starts a next cycle.

If the calculated frequency F of the PLC_PWM-PFM control signal is not equal to 10 Hz or the calculated duty ratio R of the PLC_PWM-PFM control signal is not equal to 80% at the step S63, then the processor 30 of the multicolor signal light 10 compares the calculated frequency F of the PLC_PWM-PFM control signal with a third frequency threshold, for example, 30 Hz, and compares the calculated duty ratio R of the PLC_PWM-PFM control signal with a third duty ratio threshold, for example, 70%, at a step S64.

If the calculated frequency F of the PLC_PWM-PFM control signal is equal to 30 Hz and the calculated duty ratio R of the PLC_PWM-PFM control signal is equal to 70% at the step S64, the multicolor signal light 10 emits the green light, and the process returns to the step S61 and starts a next cycle.

If the calculated frequency F of the PLC_PWM-PFM control signal is not equal to 30 Hz or the calculated duty ratio R of the PLC_PWM-PFM control signal is not equal to 70% at the step S64, then the multicolor signal light 10 does not emit light at a step S65, then the process returns to the step S61 and starts a next cycle.

In the embodiment shown in FIG. 6, each frequency threshold and its corresponding duty ratio threshold may not be equal to another frequency threshold and the duty ratio threshold corresponding to the another frequency threshold simultaneously. That is to say: the first frequency threshold may be equal to the second frequency threshold, but at this time, the first duty ratio threshold can not be equal to the second duty ratio threshold; or the first frequency threshold is not equal to the second frequency threshold, but at this time, the first duty ratio threshold may be or not equal to the second duty ratio threshold.

It should be further noted that the duty ratio would not be 100% when the emitting of the multicolor signal light is controlled by the combination of the frequency and the duty ratio.

In the control method for the multicolor signal light according to the present disclosure illustrated in FIGS. 4-6, other than the light-emitting mode of flickering, other light-emitting modes common used can also be selected, for example, a light-emitting mode in which the LED lights in the multicolor layer MC are caused to emit light with a specified color rotationally in turn clockwise or counter-clockwise; or they are caused to emit light in a light-emitting mode of combination of the flicking and rotating.

FIGS. 4-6 describe the control methods for controlling the emitting of the multicolor signal light according to the present disclosure and specially explain how to control the light-emitting color and the light-emitting mode of the multicolor signal light 10 according to the duty ratio, the frequency of the control pulse and the combination thereof. The light-emitting color and the light-emitting mode of the multicolor signal light 10 may be further controlled according to an amplitude of the control pulse. Alternatively, the light-emitting color and the light-emitting mode of the multicolor signal light 10 may be further controlled according to a combinative feature of the duty ratio, the frequency and the amplitude of the control pulse, in order to transfer rich information to the operator.

The control method for the multicolor signal light according to the present disclosure uses a PLC as an example of the controller for generating the control pulse required to control the multicolor signal light according to the present disclosure to emit light, but the present disclosure is not limited thereto, and those skilled in the art can use any other controller to generate the control pulse required herein.

From the descriptions by referring to FIGS. 2-6, the present disclosure provides a multicolor signal light controlled by the single control signal line, which has a simple structure, a low cost in control and manufacture, and a simple manufacture process.

The multicolor signal light according to the present disclosure controls the unique multicolor layer of the multicolor signal light to emit light only by one control signal PLC_CON on the single control signal line, but the multicolor signal light according to the present disclosure can provide rich information expressions, which reduces both of a control cost and a manpower cost for programming and wiring of the PLC controller of the multicolor signal light.

The multicolor signal light and the control method thereof according to the present disclosure control its light-emitting color and its light-emitting mode according to one of the features of duty ratio, frequency and amplitude of the control pulse generated by the PLC.

The multicolor signal light and the control method thereof according to the present disclosure further can control its light-emitting color and its light-emitting mode according to a combinative feature of the duty ratio, the frequency and the amplitude of the control pulse generated by the PLC.

In brief, those skilled in the art can control the light-emitting color and the light-emitting mode of the multicolor signal light according to the metrizable feature(s), which is variable, of the control signal generated by the PLC.

More widely, those skilled in the art can further control an information transferring of other devices for transferring the information such as a buzzer according to the metrizable feature(s), which is variable, of the control signal generated by the PLC.

Although embodiments of the present disclosure have been illustrated and described, those skilled in the art can understand that various changes and modifications can be made and elements in the above embodiments can be replaced with any other equivalent(s) with a development of the technique without departing from the scope of the present disclosure.

What is claimed is:

1. A multicolor signal light, comprising:

a multicolor layer comprising a plurality of lights configured to emit multicolor light and arranged in a pattern;

a single control signal line configured to receive a control signal from a controller;

a processor configured to control the multicolor layer to emit light in different modes and in different colors in response to the control signal received by the single control signal line; and power supply terminals for receiving an external power supply voltage from a power supply, wherein the processor is configured to receive from the single control signal line a control signal having a control pulse, wherein the processor is configured to control the plurality of lights to provide a light-emitting color of the multicolor signal light and at least one of a flickering mode and a rotating mode of the multicolor signal light based on a variable feature of the control pulse received, wherein the variable feature includes one of a duty ratio, a frequency and an amplitude of the control pulse received or the processor is configured to control the plurality of lights based on a combination of the duty ratio, the frequency and/or an amplitude of the control pulse received.

2. The multicolor signal light of claim 1, wherein the multicolor signal light is configured to operate with the external power supply voltage having a value of 24 VDC or 12 VDC.

3. The multicolor signal light of claim 1, wherein each of the plurality of lights includes an LED light.

4. The multicolor signal light of claim 1, wherein the processor is configured to control the plurality of lights in the flickering mode and the rotating mode at a plurality of different frequencies.

5. The multicolor signal light of claim 1, wherein the light-emitting mode includes at least one of a flickering mode and a rotating mode.

6. The multicolor signal light of claim 5, wherein the processor is configured to control the plurality of lights in the flickering mode and the rotating mode at a plurality of different frequencies.

* * * * *